US006302048B1

(12) United States Patent
Smedal

(10) Patent No.: US 6,302,048 B1
(45) Date of Patent: Oct. 16, 2001

(54) SWIVEL DEVICE

(75) Inventor: Arne Smedal, Stavanger (NO)

(73) Assignee: Hitec Systems AS, Forus (NO)

( * ) Notice: Subject to any disclaimer, the term of this patent is extended or adjusted under 35 U.S.C. 154(b) by 0 days.

(21) Appl. No.: 09/529,089

(22) PCT Filed: Oct. 7, 1998

(86) PCT No.: PCT/NO98/00304

§ 371 Date: Oct. 23, 2000

§ 102(e) Date: Oct. 23, 2000

(87) PCT Pub. No.: WO99/17983

PCT Pub. Date: Apr. 15, 1999

(30) Foreign Application Priority Data

Aug. 10, 1997 (NO) ..... 19974640

(51) Int. Cl.[7] ..... B63B 21/00; B63B 22/02
(52) U.S. Cl. ..... 114/230.12; 441/5
(58) Field of Search ..... 114/230.12; 441/5; 141/387, 388; 166/354, 355; 405/195.1, 224

(56) References Cited

U.S. PATENT DOCUMENTS

| | | | | |
|---|---|---|---|---|
| 4,305,341 | | 12/1981 | Stafford . | |
| 4,436,048 | * | 3/1984 | Gentry et al. | 114/230.12 |
| 4,648,848 | * | 3/1987 | Busch | 441/5 |
| 4,698,038 | | 10/1987 | Key et al. . | |
| 4,701,143 | | 10/1987 | Key et al. . | |
| 5,359,957 | | 11/1994 | Askestad . | |
| 5,755,607 | * | 5/1998 | Boatman et al. | 441/5 |
| 5,823,837 | * | 10/1998 | Boatman et al. | 441/5 |
| 5,860,840 | * | 1/1999 | Boatman et al. | 441/5 |
| 6,014,939 | * | 1/2000 | Gusmeri et al. | 114/230.12 |

FOREIGN PATENT DOCUMENTS

| | | |
|---|---|---|
| 371668 | 6/1990 | (EP) . |
| 2118903 | 11/1983 | (GB) . |
| 2285028 | 6/1995 | (GB) . |

* cited by examiner

*Primary Examiner*—Ed Swinehart
*Assistant Examiner*—Andy Wright

(57) ABSTRACT

A swivel device for a ship (10) equipped so as to serve as i.a. a production and/or a drilling ship by exploitation of submarine wells or reservoirs, respectively, containing oil and/or gas, where the ship (10) is formed with a vertically through-going shaft (12). Within the shaft (12), a turret (16) having a substantially vertical axis is rotatably mounted in relation to the hull and is included in said swivel device. Thus, when the turret (16) is moored to the seabed, the ship (10) may turn about said vertical axis, dependent on wind and/or sea currents. The swivel device comprises a first pipe (32) substantially concentrical with the turret (16) and with a smaller external diameter than the internal diameter of the turret (16), so that, between the outside of said first pipe (32) and the inner side of the turret (16), a vertically through-going annulus is formed for accommodating of several production risers (34). Said first pipe's (32) bore constitutes a vertically through-going passage for separate passage and accommodation of a drill pipe string. Said first pipe (32) is connected to the turret (16).

4 Claims, 3 Drawing Sheets

SWIVEL DEVICE

BACKGROUND OF THE INVENTION

The invention relates to a swivel device for use in a ship equipped for carrying out production/ drilling, etc., in connection with submarine oil/gas wells, said ship being formed with a vertically through-going shaft accommodating a turret rotatably mounted to the ship's hull around a vertical rotational axis, about which the ship may turn when the turret is moored to the seabed by means of anchor lines, preferably in the form of mooring chains.

Through the shaft which is surrounded by the turret, it is possible to lower down and draw up a riser production tubing string, and at a lowermost shaft portion widened through a conical transition portion it is possible to accommodate a so-called STL-buoy which is an immersed buoyancy body moored to the seabed and having transition pieces for risers each extending to a well head.

In the mooring arrangement of the turret, at least one mooring chain might be included, said mooring chain having a fixed length and, for the attachment of its upper end to the turret, is assigned an attachment hook, the other chains included in the mooring arrangement having changeable length and each being assigned thereto a guide pulley at the level of the hook(s) and, preferably, also an individual winch disposed at a higher level than the attachment hook(s) as well as an individual locking means for locking the respective, longitudinally changeable mooring chain in stretched, tensioned, shortened condition.

The turret may, in addition to its rotatable mounting around a vertical axis, be raisable/lowerable for temporarily uncovering and making available underlying structure, e.g. said attachment hooks for some of the mooring chains.

The turret's mounting device for the relative rotatability between ship and turret may, intermediate ship's hull and turret, comprise an upper combined roller-ball bearing and a lower roller bearing, each roller having a vertical axis.

Alternatively to a physical mooring to the seabed, the ship may be positioned on the field through so-called dynamic positioning as previously known.

SUMMARY OF THE INVENTION

By means of the present invention one has aimed at, through simple means, to provide a swivel device adapted to put a ship of the kind described above in a position to carry out production as well as drilling, possibly simultaneously.

In accordance with the invention, this object is realized by means of a swivel device distinguishing itself through the features as defined in the claims.

According to the invention, spaced radially inwardly of the turret, within said vertically through-going shaft, is disposed a first pipe substantially concentrically with the turret, the outside of said first pipe together with the inner side of the turret defining a vertically through-going annulus for the accommodation of a larger or smaller number of production risers, vertically directed passage possibility for drill pipes being available in the central bore of the first pipe.

If one wishes to have a possibility of connecting the shop temporarily to a STL buoy which, for its connection to the ship, requires a cavity therein having an upwardly conically tapering cavity portion in the bottom of said vertically through-going shaft, such a tapering portion may be formed from the end of a second pipe taking a substantially concentrical positioning within said first pipe. In this case, it is the bore of said second pipe that forms the central, separate passage possibility for drill pipe(s) and downhole accessories. Vertically above the vertically through-going shaft, the ship will normally be equipped with a rig structure in which a top driven rotary system for a drilling string is disposed.

BRIEF DESCRIPTION OF THE SEVERAL VIEWS OF THE DRAWING

An exemplary embodiment of a diagrammatically illustrated swivel device according to the invention is further explained in the following, reference being made to the accompanying drawings, in which.

DETAILED DESCRIPTION OF THE INVENTION

Figure 1:
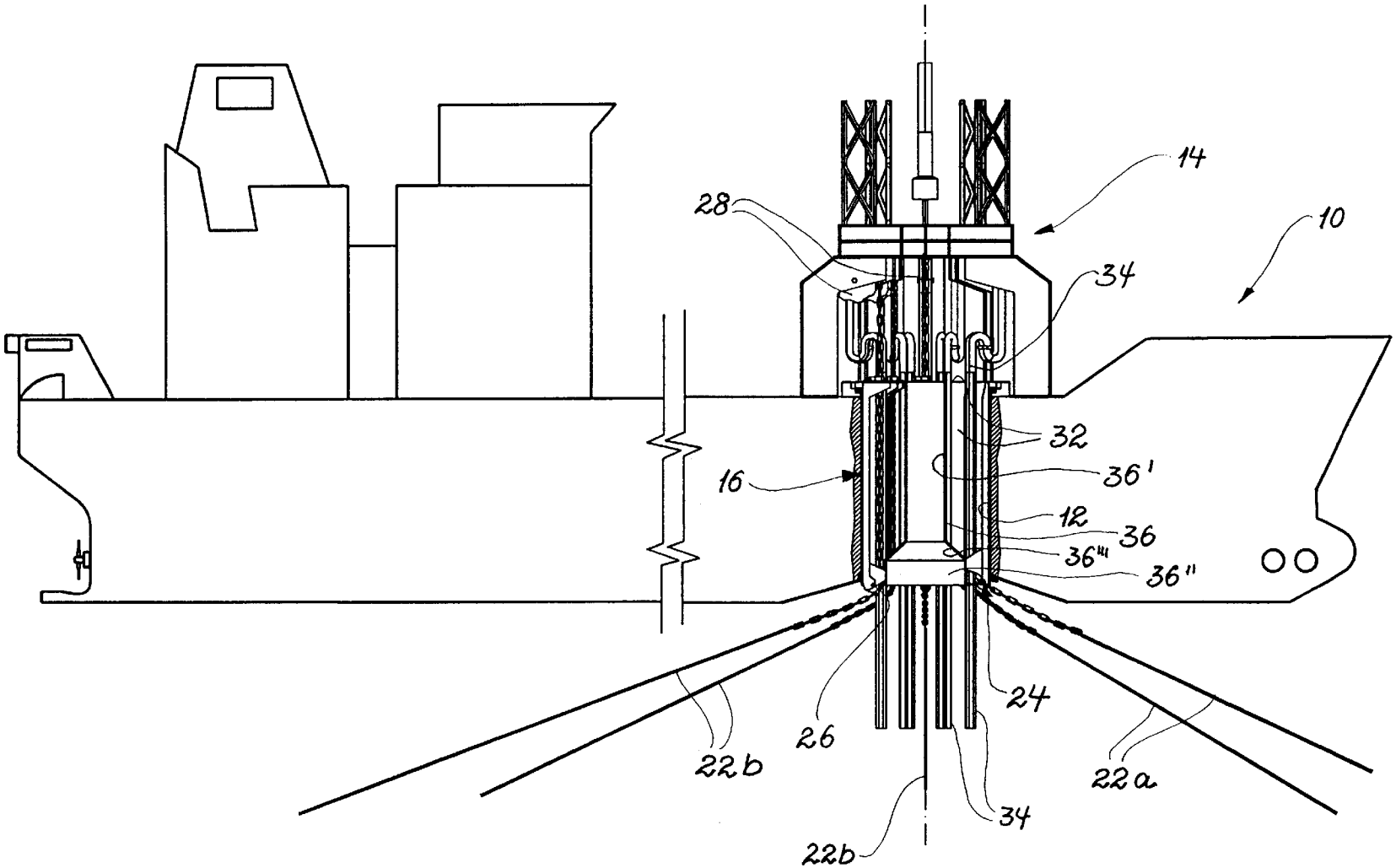
FIG. 1 shows in a side elevational view a ship of the type with which a swivel device according to the invention may be used, and where the area of the vertically through-going shaft has been shown in vertical section.

As previously known, according to FIG. 1, a ship 10 is formed with a vertically through-going shaft 12 assigned an overlying rig structure 14.

Figure 2:
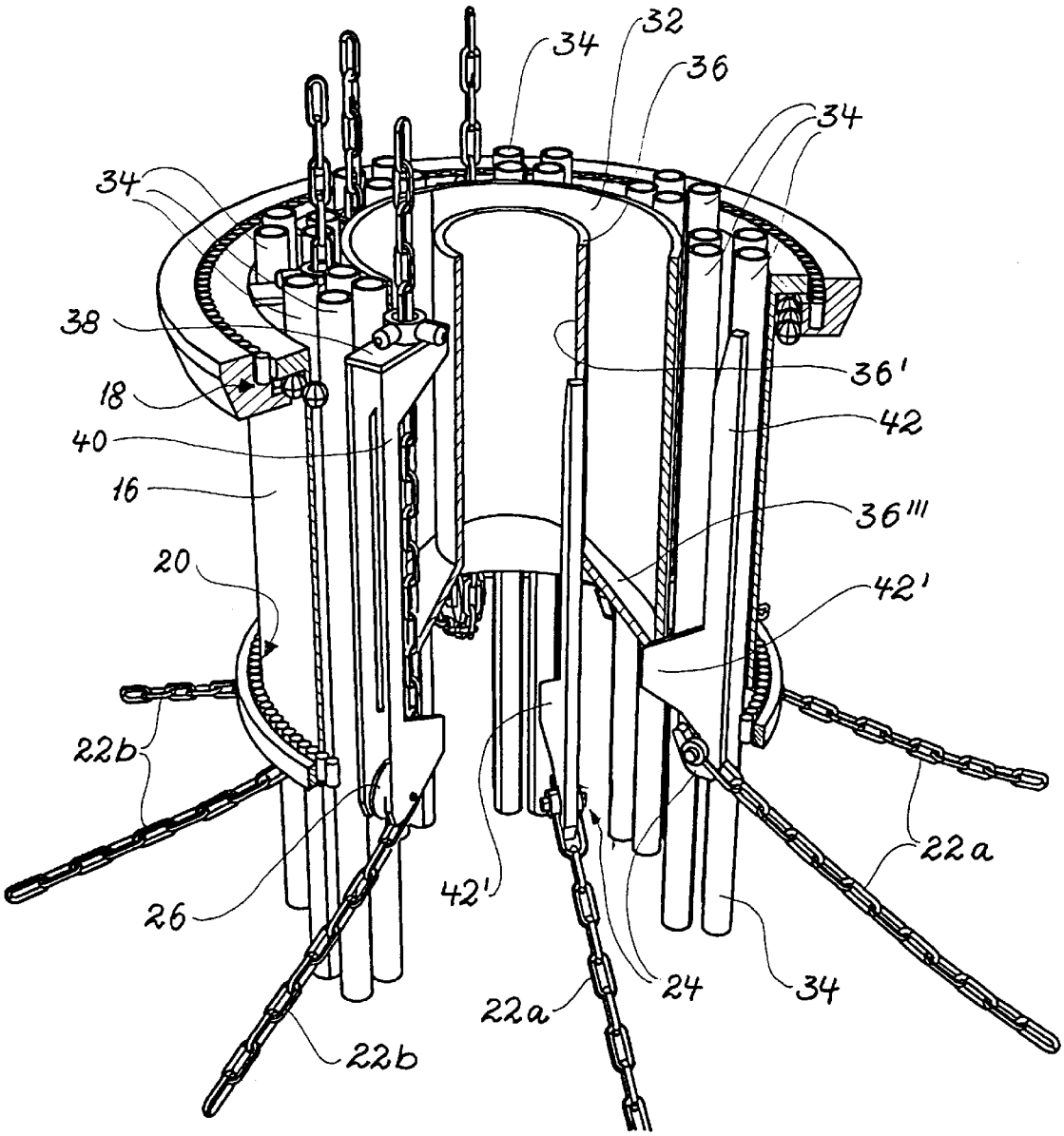
FIG. 2 shows in a perspective view a swivel device according to the invention separately, portions being cut away in order to illustrate the internal shape and design as well as mooring chains connected thereto.
Figure 3:
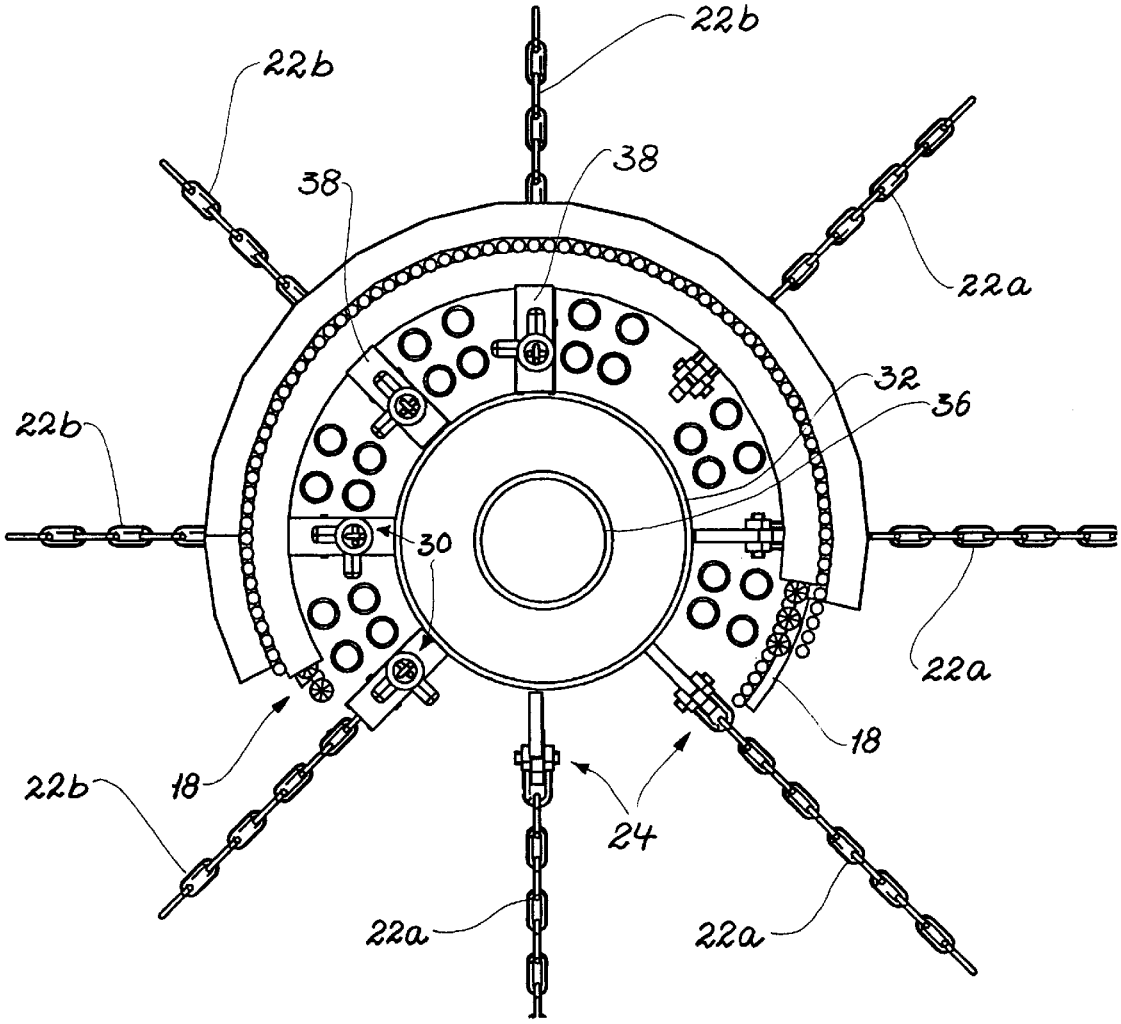
FIG. 3 is a top plan view of the swivel device as shown in FIG. 2, with cut away portions and mooring chains connected thereto.

Within the vertically through-going shaft 12 is, as known per se, rotatably mounted a turret 16, see especially FIG. 2, by means of an upper combined roller-ball bearing 18 and a lower roller bearing 20. In the exemplary embodiment, the turret 16 is moored to the seabed (not shown) by means of mooring chains 22*a* each having a fixed length and suspended lo from attachment hooks 24 as well as mooring chains 22*b* each having a changeable length and, through an individual guide pulley 26, extending to an individual winch 28. An intermediate locking means 30 for each longitudinally changeable mooring chain 22*b* in stretched, tensioned and shortened condition is may comprise a locking bolt insertable into a link of the chain, thus locking the respective chain. The mooring arrangement and details thereof do not constitute subject matter of the present invention.

Concentrically with the turret 16, a first pipe 32 is disposed. This pipe may have almost the same vertical extent as the turret 16, FIG. 1, and has a considerably lesser diameter than this one so that, between the outside of first pipe 32 and the inner side of turret 16, an axially through-going annulus is formed, the radial extent thereof being sufficient to accommodate a number of risers 34.

Concentrically within said first pipe 32, a second pipe 36 having a smaller diameter then said first pipe 32 is disposed. Said second pipe 36 which has a vertically through-going bore 36', is intended to allow separate passage of a drill pipe string rotatable from a rotary system, not shown, preferably suspended from the ship's rig structure 14. The radially innermost, second pipe 36 is lowermost formed with a. widened, circular-annular portion 36" having approximately the same external diameter as said first pipe 32 and being connected to the remaining part of the pipe 36 through an upwardly tapering transition portion 36'" internally shaped complementarily to a STL buoy (not shown).

Said second pipe's 36 lower edge portion may be fastened to said first pipe 32, which is connected to the jacket of turret 16 through radially directed struts 38 carrying the locking means 30 and, from which, bars 40 each having a guide pulley 26 suspend. The radially outermost, vertical edge faces thereof may be attached to the turret 16 through welding or the like. Similar bars 42 each having a lower attachment hook 24 have each a radially inwardly facing attachment portion 42' for connection to said first pipe 32. The radially outermost, vertical edge faces of the bars 42 may be fastened in a similar way as the bars 40.

What is claimed is:

1. A swivel device for a ship used for the exploitation of hydrocarbon wells in the seabed by means of drill pipe strings and risers, said ship being formed with a vertical shaft extending through the hull of the ship, said swivel device comprising:

a turret having a substantially vertical axis, said turret being rotationally supported in the shaft so that said shaft can rotate relative to said turret to allow the ship to move about said vertical axis responsive to environment conditions to which it is subjected, said turret having an internal surface, the internal surface of said turret being provided with substantially vertical bar-like members extending from said internal surface, each of said bar-like members engaging a mooring chain, certain of said bar-like members, at the lower ends thereof, carrying an attachment hook for a mooring chain of fixed length, others of said bar-like members, at the lower ends thereof, carrying a guide pulley for a mooring chain, the length of which can be varied, said turret having a locking device for locking a variable length chain to said turret;

a first pipe positioned in said turret substantially concentrically therewith with respect to said vertical axis and connected to said turret by means of said bar-like members, said internal surface of said turret facing an external surface of said first pipe, said internal surface of said turret being spaced from said external surface of said first pipe along said surfaces to form a vertically through going annular passage for accommodating at least one riser; and a second pipe connected to said first pipe and positioned in said first pipe substantially concentrically therewith so that an internal surface of said first pipe is spaced from and faces an external surface of said second pipe, said second pipe having a central through going bore for accommodating a string of drill pipe separately from said at least one riser, said second pipe, at a lower end along said vertical axis, being formed with a pipe wall portion widening in a downward direction and adapted to receive a buoy.

2. A swivel device as set forth in claim 1, wherein certain of said bar-like members have a radially inwardly directed fastening portion secured to said first pipe.

3. A swivel device as set forth in claim 1, wherein said turret and said first and second pipes have substantially the same length along said vertical axis.

4. A swivel device as set forth in claim 1, wherein at a lower end of said turret, said first and second pipes are terminated approximately at the level of said attachment hooks and guide pulleys.

* * * * *